US005257968A

United States Patent [19]

Caldwell

[11] Patent Number: 5,257,968

[45] Date of Patent: Nov. 2, 1993

[54] INFLATABLE DAM FOR A DECANTER CENTRIFUGE

[75] Inventor: John W. Caldwell, Glenside, Pa.

[73] Assignee: Alfa Laval Separation Inc., Warminster, Pa.

[21] Appl. No.: 711,479

[22] Filed: Jun. 6, 1991

[51] Int. Cl.[5] ..... B04B 1/20

[52] U.S. Cl. ..... 494/53; 494/56

[58] Field of Search ..... 494/52, 53, 54, 56, 494/57, 22, 23, 25, 27, 28, 30, 48

[56] References Cited

U.S. PATENT DOCUMENTS

| | | | |
|---|---|---|---|
| 992,876 | 5/1911 | Jones . | |
| 1,776,554 | 9/1930 | Gale . | |
| 2,104,162 | 1/1938 | Macklind | 233/2 |
| 2,661,150 | 12/1953 | Abbott, Jr. | 494/27 |
| 3,168,472 | 1/1965 | Fitzsimmons | 233/19 |
| 3,172,851 | 3/1965 | Ambler | 233/7 |
| 3,179,334 | 4/1965 | Sharples | 233/20 |
| 3,244,363 | 4/1966 | Hein | 233/28 |
| 3,248,323 | 4/1966 | Albertson | 210/6 |
| 3,393,863 | 7/1968 | Baram | 494/27 |
| 3,398,888 | 8/1968 | Koenecke et al. | 233/47 |
| 3,456,875 | 7/1969 | Hein | 233/24 |
| 3,494,546 | 2/1970 | Nilson | 233/20 |
| 3,501,346 | 3/1970 | Katzen et al. | 127/56 |
| 3,532,265 | 10/1970 | Baram | 494/27 |
| 3,580,492 | 5/1971 | Schnittger | 233/7 |
| 3,623,658 | 11/1971 | Garbaty | 233/20 R |
| 3,749,303 | 7/1973 | Hemfort | 233/20 A |
| 3,795,361 | 3/1974 | Lee | 233/7 |
| 4,189,068 | 2/1980 | Apellaniz | 222/83.5 |
| 4,335,846 | 6/1982 | Shapiro | 233/7 |
| 4,575,370 | 3/1986 | LaMontagne | 494/56 |
| 4,820,256 | 4/1989 | Nordstöm | 494/3 |

FOREIGN PATENT DOCUMENTS

| | | | |
|---|---|---|---|
| 0186761 | 7/1986 | European Pat. Off. . | |
| 3822983 | 1/1990 | Fed. Rep. of Germany | 494/53 |
| 3921327 | 1/1991 | Fed. Rep. of Germany . | |
| 2233258 | 1/1991 | United Kingdom . | |

*Primary Examiner*—Harvey C. Hornsby
*Assistant Examiner*—Randall E. Chin
*Attorney, Agent, or Firm*—Seidel, Gonda, Lavorgna & Monaco

[57] ABSTRACT

A decanter centrifuge having an inflatable dam for controlling the pond level. Inflation of an annular bladder adjacent to the liquid discharge opening controls the radial height of the pond surface within the bowl of the centrifuge.

42 Claims, 10 Drawing Sheets

FIG. 20
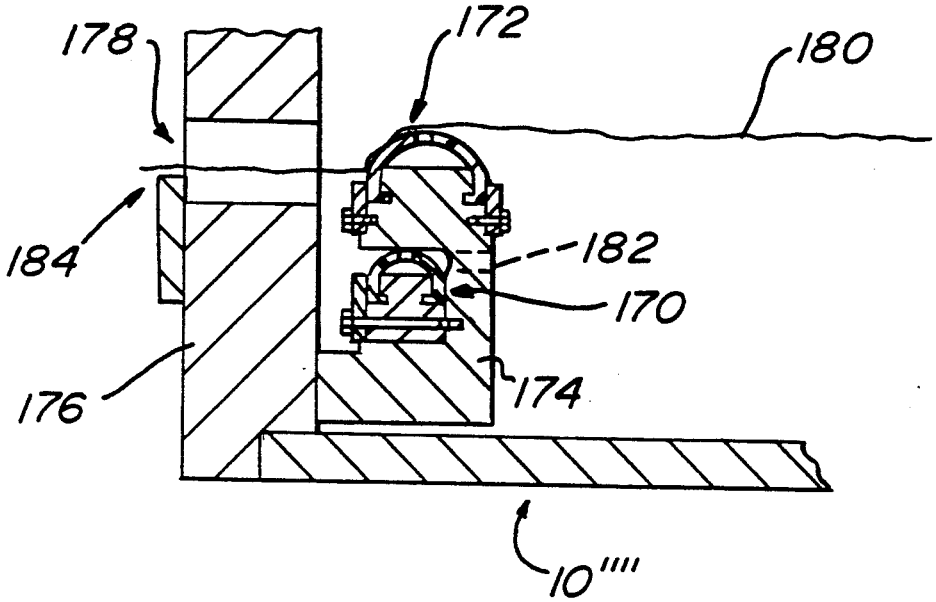
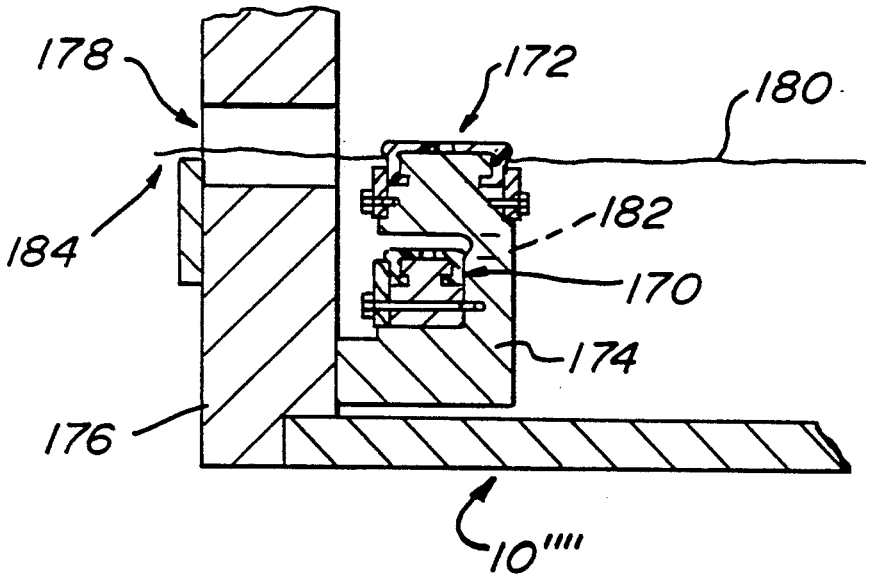
FIG. 19

INFLATABLE DAM FOR A DECANTER CENTRIFUGE

FIELD OF THE INVENTION

The present invention relates to a decanter centrifuge. In particular, the present invention relates to the control of the pond level within a decanter centrifuge so as to vary the characteristics of the separated solids discharge and the liquid centrate. This control of the discharge characteristics is made during the operation of the centrifuge.

BACKGROUND OF THE INVENTION

The depth of the pond in a decanter centrifuge is particularly relevant to its successful operation. This fact is particularly true when the centrifuge is operating in an "above spillover" condition. An above spillover condition occurs when the pond surface in the bowl of the centrifuge is radially inward of the solids weir surface.

The operational characteristics of a decanter centrifuge in an above spillover condition are described in various forms in Ambler U.S. Pat. No. 3,172,851 and Lee U.S. Pat. No. 3,795,361. In the Ambler device, a solids dam must form at the solids discharge weir in order for the liquid layer to provide its contemplated hydraulic assistance to the solids discharge. In the Lee construction, the baffle projecting from the conveyor hub must penetrate and seal with the solids layer within the centrifuge bowl to create a centrifugal pressure head assist to the conveyor in the discharge of the separated solids. The relative difference in radius between the solids and liquid weir surfaces can be used to create the above spillover condition and be used to control the operation and performance of a decanter centrifuge. However, precise control over the parameters of the above spillover operation is often required. (The Ambler and the Lee patents as identified above are herein incorporated by reference.)

During start up of a decanter centrifuge operating in an above spillover condition, a solids layer must be built up within the bowl in order for the centrifuge to reach a steady state operation. In both the Ambler and Lee type operation, because the solids weir is typically radially outward of the liquid weir, the liquid feed mixture will discharge over the solids weir during start up prior to reaching steady state operation. This condition will also occur during a "wash-out", until the dam or seal are again formed. The reformation of the dam or seal to again achieve a steady state operation may require significant operator attention and result in substantial loss of operation time for the centrifuge. Liquid discharge through the solids discharge ports is normally considered unacceptable.

LaMontagne U.S. Pat. No. 4,575,370 shows a liquid discharge weir for a decanter centrifuge that operates under different conditions based upon the feed rate into the centrifuge. In LaMontagne, the weir plates for the liquid discharge include a notch or the like which interrupts the weir surface. At low flow rates, the liquid is discharged through the notch which is at a position radially outward of the solids discharge weir. At higher flow rates, such as that of normal operation, the flow over the liquid discharge weir is great enough to raise the level of the pond within the bowl radially inward of the solids discharge weir, i.e., to an above spillover condition. Thus, LaMontagne contemplates that the flow rate may be used to control the operational characteristics of start up and prevent liquid discharge through the solids discharge ports. (The LaMontagne patent identified above is herein incorporated by reference.)

The Lee decanter centrifuge creates a centrifugal pressure head which directs the solids through the annular passageway defined by the baffle periphery and the bowl wall to assist in the discharge of the solids. It has been found that this pressure head substantially improves the operation of a decanter centrifuge in particular with respect to a thickening type operation. The Lee type centrifuge has also been found applicable to what is known as "difficult-to-convey" type solids. These difficult-to-convey solids are normally not dischargeable from a decanter centrifuge by the screw conveyor alone and often require the use of polymers or the like to create acceptable separation.

In certain situations in the operation of a Lee type decanter centrifuge, the concentration of the solids discharge is difficult to control. In waste water thickening, the production of a cake having up to a 4% solids concentration is possible typically on a consistent basis. Also, the production of a solids concentration in excess of 8% is consistently possible. However, in the range between 4% and 8%, it is often difficult to produce a consistent cake concentration. The reason for this difficulty is attributed to the inability to precisely control the pond level and to adjust for changes in feed rate and feed solids concentration.

Operation of a Lee type decanter centrifuge in an above spillover condition has been found to be most advantageous in waste water thickening. However, similar advantages have been found for an above spillover condition in the concentration of solids in a dewatering-type operation, in which the solids concentration is usually greater than 20%.

It is known to use an inflatable type dam within a centrifuge for creating a liquid-liquid separation. Such an inflatable dam is shown in Sharples U.S. Pat. No. 3,179,334. However, a liquid-liquid type separation includes different operational characteristics and parameters from those in a liquid-solids type separation of a decanter centrifuge. In the operation of a decanter type centrifuge, the depth of the pond within the centrifuge is often critical to successful operation and in controlling the characteristics of the separated solids discharge and the liquid centrate. Variation in the depth of the pond in a liquid-liquid separation is useful in locating the liquid-liquid interface to control liquid clarity.

The relative change in operation of a centrifuge used for a liquid-liquid type separation as compared to that of a decanter centrifuge used for a liquid solids type separation as a function of the radial difference between the weir surfaces of the separate discharges displays the differences in operational characteristics and the different parameters of operation of the two types of centrifuges. The following is an outline of some of these differences, making reference to a Lee type decanter centrifuge.

One operational characteristic of a centrifuge is the location in the centrifuge bowl of the interface between the lighter density material (typically a liquid) and the heavier density material (either a liquid or a solids type material). In a liquid-liquid type separation, the interface is considered to be relatively sharp and well defined. However, in a decanter type centrifuge this sharp definition is not necessarily found. The location of the interface in a liquid-liquid centrifuge is the function of the density ratio of the two liquids being separated and the relative distance from the axis of rotation of the weir surfaces for the two materials being discharged. The location of the interface in a Lee-type decanter centrifuge is a function of the density difference between the liquid and solids (with the solids concentration varying at different radial positions in the bowl), the relative radial difference between the weir surfaces, the rate of the feed into the bowl, the solids concentration in the feed, the differential speed of the screw conveyor with respect to the bowl, the speed of rotation of the bowl, and the compactability of the solids material.

A change in the feed rate in a decanter centrifuge will result in a change in the location of this interface and the discharge characteristics of the solids. An increase in the feed rate will typically result in the interface moving radially inward. Feed rate changes in a liquid-liquid type separation do not result in substantial changes in the discharge characteristics or a movement of the interface.

Moving the light liquid discharge weir surface radially inward in a liquid-liquid separation (i.e. raising the pond surface with respect to the heavy liquid discharge weir) will result in the interface moving radially outward. However, the flow rate of both the light and heavy liquids are not affected by the change in weir location. If the liquid discharge weir surface is moved radially inward in a Lee-type decanter centrifuge, the interface will move radially outward and the solids discharge flow rate will increase as the cake concentration in the solids decreases. This change is a function of the centrifugal pressure head being increased by the higher level of liquid above the solids discharge weir. This increased pressure head results in greater assist to the conveyor in discharging the solids and, thus, the faster solids discharge flow rate. The solids concentration in the discharge will also decrease because, at a constant rate of solids in the feed and a greater output flow rate, there is a net decrease in the amount of solids retained in the centrifuge bowl. The interface is moved as a result of the increase in the centrifugal pressure head in the separation zone and the reduction in solids concentration.

These operational differences between a decanter centrifuge and a liquid-liquid type separation can be attributed to the fact that the two centrifuges are structurally different and function according to different physical principles. A liquid-liquid type separation does not provide a supplemental discharging force as a result of the variation of the relative position of light liquid discharge weir as in the Lee type decanter centrifuge. Manifestly, any similarities between the presently contemplated structure and prior structures are not suggestive of the present invention.

BRIEF DESCRIPTION OF THE INVENTION

The present invention relates to a decanter type centrifuge having a rotating solid bowl and screw conveyor. The bowl of a typical decanter centrifuge includes a cylindrical section and a frusto-conical section at one end. The decanter centrifuge is intended to separate a feed material including a mixture of liquid and solids and to separately discharge a clarified liquid and a concentrated mixture of solids and liquid. Means is provided adjacent to the liquid discharge ports in the centrifuge bowl for continuously varying during operation the radial position of the liquid discharge weir relative to the solids discharge weir. This continuously varying means includes an annular inflatable dam. Means is provided for controlling the amount of inflation of the annular dam so as to vary the pond level in the bowl and the relative discharge characteristics of the solids from the centrifuge.

The present invention preferably includes an annular baffle that penetrates into the thickened solids layer within the bowl so as to form an annular passageway for the underflow of only thickened solids from the cylindrical portion of the bowl to the conical portion of the bowl and for the creation of a centrifugal pressure head discharge assist as described in the Lee patent, identified above and herein incorporated by reference. The present invention may also include a separate outside weir surface structure adjacent to the inflatable dam so as to reduce the power requirements for rotating the centrifuge bowl. Further variations of the invention are also contemplated and are discussed in detail below.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

FIG. 19 is a cross-sectional view of a still further embodiment of a centrifuge in accordance with the present invention.

FIG. 20 is a second view of the embodiment of the invention shown in FIG. 19.

DETAILED DESCRIPTION OF THE DRAWINGS

Figure 1:
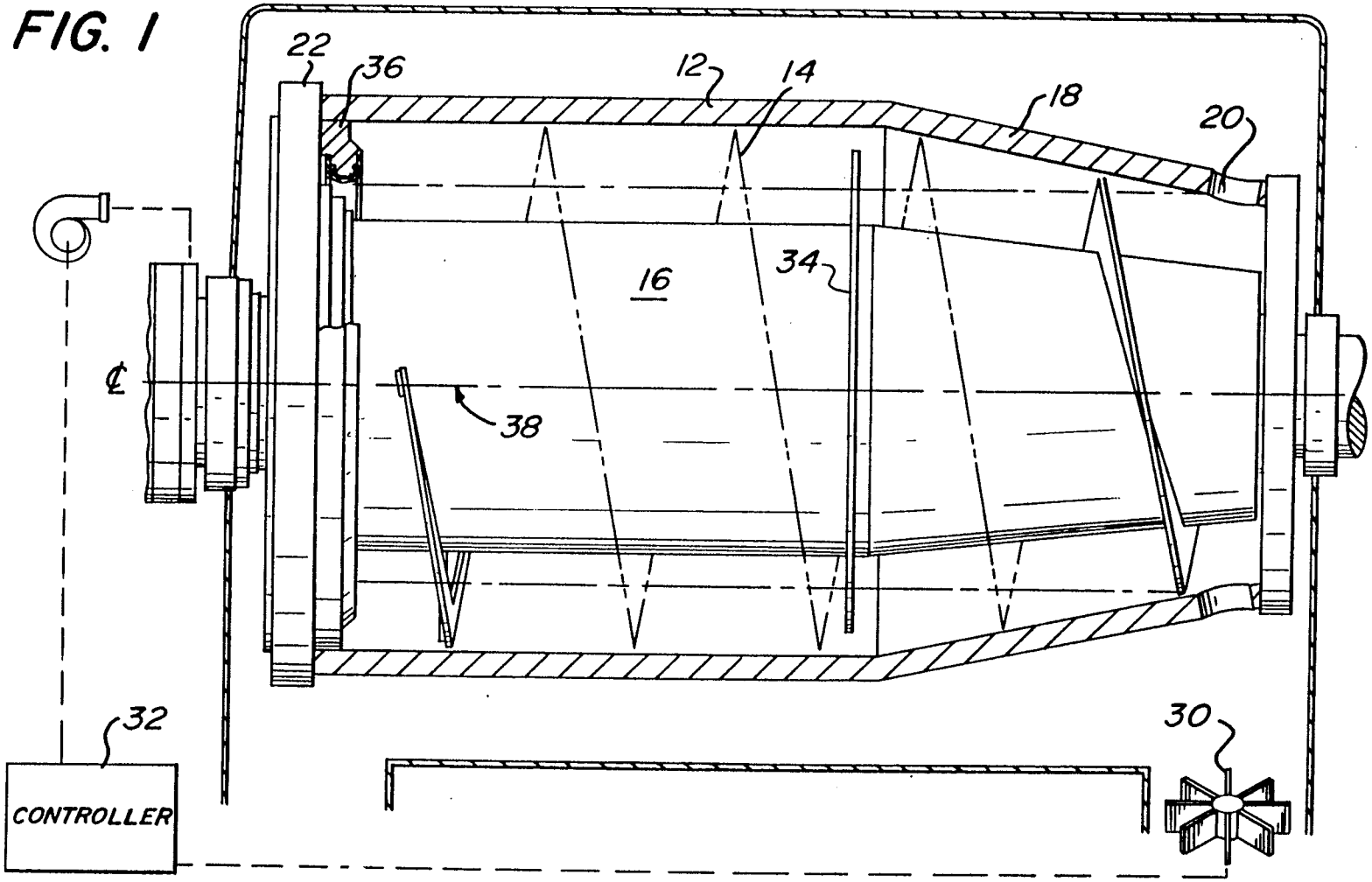
FIG. 1 shows a cross-sectional view of a decanter centrifuge in accordance with the present invention.
Figure 2:
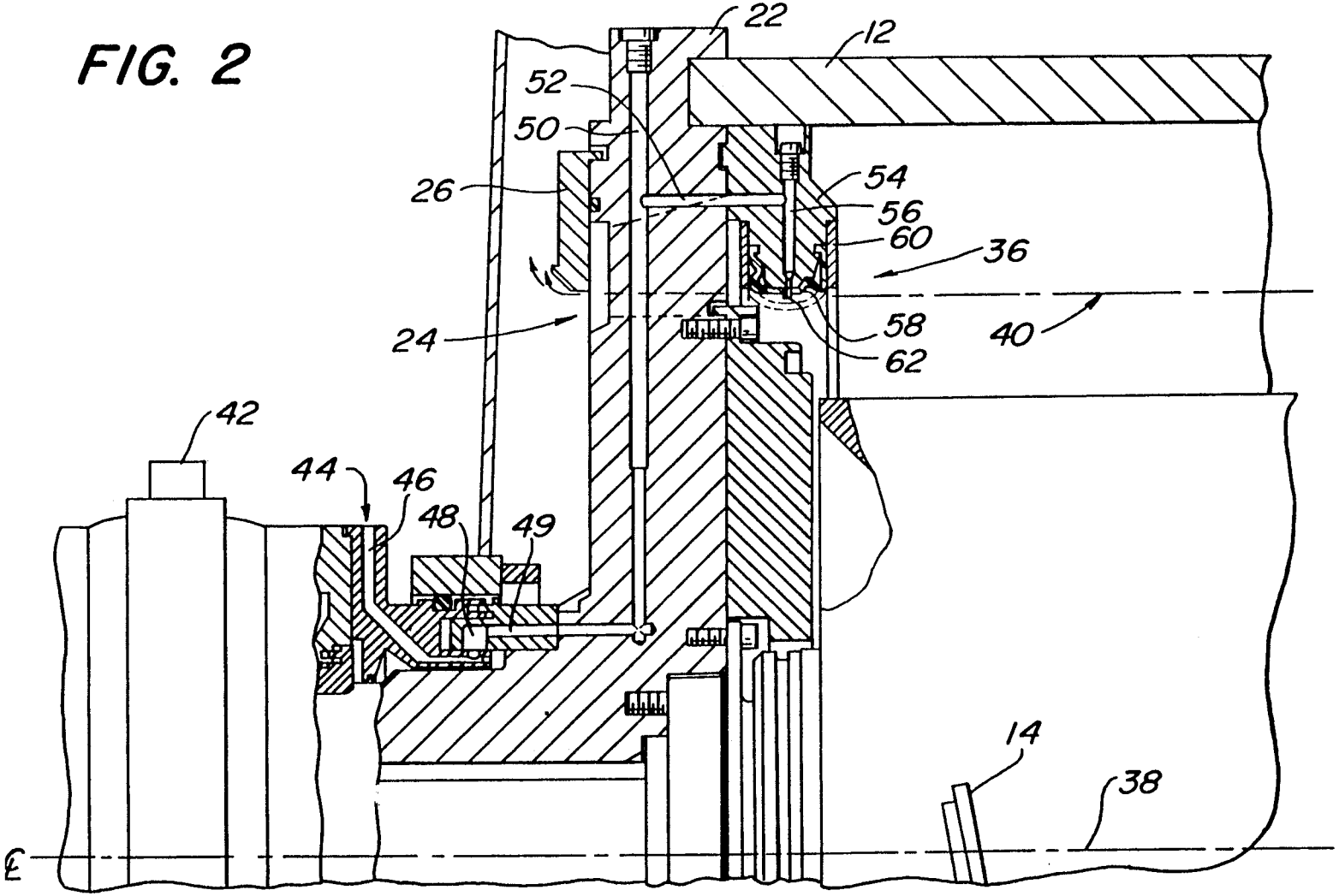
FIG. 2 is an enlarged cross-sectional view of the decanter centrifuge shown in FIG. 1 including details of the inflatable dam structure of the present invention.

In the drawings where like numerals indicate like elements there is shown in FIGS. 1 and 2 a decanter centrifuge which is generally referred to by the numeral 10. As illustrated in FIG. 1, the decanter centrifuge 10 includes a bowl 12 and a screw conveyor 14. The screw conveyor 14 includes a series of conveyor flights which are mounted on a conveyor hub 16. The screw conveyor 14 rotates inside the bowl 12 at a relative differential speed with respect to the bowl so as to push continuously the separated solids material (not shown) along the length of the inside bowl wall towards the conical or beach section 18. At the top of the beach 18 is a solids discharge outlet or opening 20 having a weir surface thereon. The front hub 22 on the bowl is positioned at the opposite end of the bowl 12 from the solids discharge 20. As illustrated in FIG. 2, the bowl hub 22 generally includes a liquid discharge outlet 24 having a liquid discharge weir plate 26 thereon. The operation of the decanter centrifuge is controlled as a function of the solids concentration which is discharged through the solids outlets 20. A viscosity meter 30 or the like is positioned within the discharge chute in the casing 28 for the decanter centrifuge 10. The meter 30 measures the viscosity or other parameters of the solids discharge and sends a signal to a controller 32. The controller 32, in turn, sends a signal to other elements of the centrifuge to control the speed of rotation of the conveyor 14, the feed rate into the decanter centrifuge 10, the inflation of the inflatable dam structure, etc., so as to vary the operational characteristics. Alternately, a meter could be positioned to measure viscosity, turbidity, or other parameters of the liquid discharge and send a signal to controller 32.

As illustrated in FIG. 1, a baffle 34 is usually mounted on the conveyor hub 16. The baffle 34 extends to a radial position proximal to the inside wall of the bowl 12 and usually adjacent the joinder of the cylindrical section with the beach 18. The baffle 34 is intended to operate in accordance with Lee U.S. Pat. No. 3,795,361. Adjacent to the bowl hub 22 is provided an inflatable dam structure 36. The structural elements of inflatable dam of the present invention are described in detail below by making reference to the remaining figures.

FIG. 2 illustrates in cross-section, one embodiment of inflatable dam 36 as contemplated by the present invention. The inflatable dam 36 is positioned adjacent to the liquid discharge outlet 24 within the bowl hub 22. It is generally contemplated that more than one liquid discharge outlet 24 is provided in the bowl hub 22. The inflatable dam 36, as illustrated, is continuous and/or annular, circling around the central longitudinal axis 38 of the bowl 12 and the conveyor 14. The weir plate 26 is fixed to the outside surface of the bowl hub 22 so as to define a position that is radially outward of position of dam 36 in its collapsed or uninflated condition. The uninflated dam 36 is preferably set to provide a below spillover type operation (i.e., the liquid weir surface being radially outward of the solids discharge weir). Dam structure 36 is inflatable so as to change the relative radial position of the pond surface 40. This change in the radial position of the pond surface 40 is created by the inflation of the bladder portion 58 of inflatable dam 36 to the position illustrated in dotted lines in FIG. 2. This inflation of dam 36 can result in an above spillover condition.

The inflation of dam 36 is created by supplying a control liquid from a head tank, a pump, or the like (not shown) into the centrifuge. In FIG. 2, the control liquid is introduced through the pillow block 42. The control liquid is input through passage 44 which communicates with passageway 46. Passages 44 and 46 are located within the stationary portions of the centrifuge mounting structure. The control liquid is then directed into collection trough 48 and internal passageway 49 within the rotating structure attached to the bowl hub 22. The control liquid is directed from trough 48 and passageway 49 into one or more radially projecting passageways 50 extending through the bowl hub 22. Radial passageways 50 connect to the inflatable dam structure 36 through axial passageways 52. Inflatable dam 36 includes a mounting block 54 connected to the inside surface of bowl hub 22. Each axial passageway 52 extends through the bowl hub 22 and communicates with passageway 56 within the mounting block 54. The proximal relationship of the rotating structures with the stationary structures has not been detailed in the figures. These details are considered to be within the skill of the art. However, the communication structures may include seals, such as a clipper seal or the like, for preventing the liquid discharge from contaminating the joint area.

Attached to mounting block 54 is inflatable bladder 58. Bladder 58 is secured to the mounting block 54 by means of clamping disks 60. The bladder 58 is generally contemplated to have a U-shaped cross-section. A lip is provided on the projected ends or legs of the U-shape. The bight of the U-shape projects radially inwardly and forms a weir surface for the liquid discharge. When a control liquid is fed through the series of passageways 44, 46, 48, 49, 50, 52 and 56, the bladder 58 is inflated away from (radially inward) the mounting block 54. This inflation changes the shape of the bladder 58 and moves the radial position of the pond surface 40 inward. Thus, the level of the liquid pond surface 40 passing over the bladder 58 also changes in radial distance with respect to the solids weir in outlet 20.

The bladder 58 illustrated in FIG. 2 includes one or more leak bushings 62 which permit the control liquid to pass therethrough. To control both the inflation and deflation of the bladder 58, the rate or volume of the control liquid fed into the bladder is varied. Variations in the volume of the control liquid results in a variation of the amount of inflation of the bladder 58. Increasing the volume of the control liquid fed into the passage 44, increases the liquid head retained within the radial passageway 50. The pressure created by the liquid head, which is increased in magnitude as a result of the centrifugal force created by the rotation of the bowl, inflates the bladder. The control liquid because of the pressure of the liquid head is discharged through the leak bushing 62. Upon reaching equilibrium, the rate or volume of flow into the input passageway 44 is equal to the flow through the leak bushing 62. Decreasing the flow of control liquid reduces the inflation of the bladder and increases the relative radial position of the bladder 58. Leak bushing 62 permits the variation of the volume of control liquid input through the inlet 44 to be the controlling parameter for bladder inflation.

The leak bushing could also be provided on passageways 50, 52, or 54 at a position radially outward of the bladder 58. In this variation the discharge from the leak bushings would preferably be directed outside of the bowl. Mounting of the leak bushings at the most radially inward position on the bladder will prevent air pockets from forming in the bladder. Air pockets could prevent deflation of the bladder.

Figure 3:
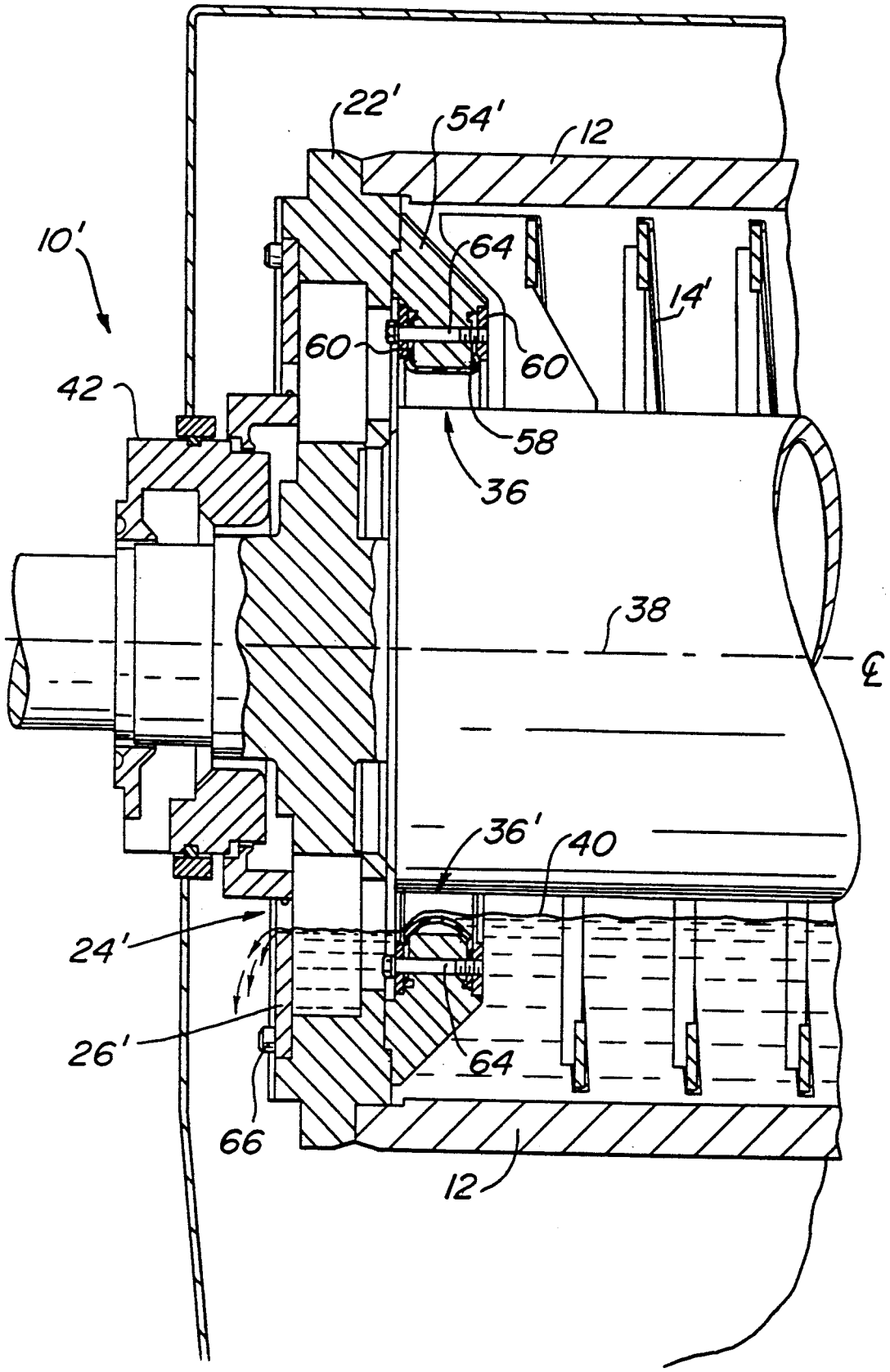
FIG. 3 is a cross-sectional view showing a second embodiment of the present invention.
Figure 4:
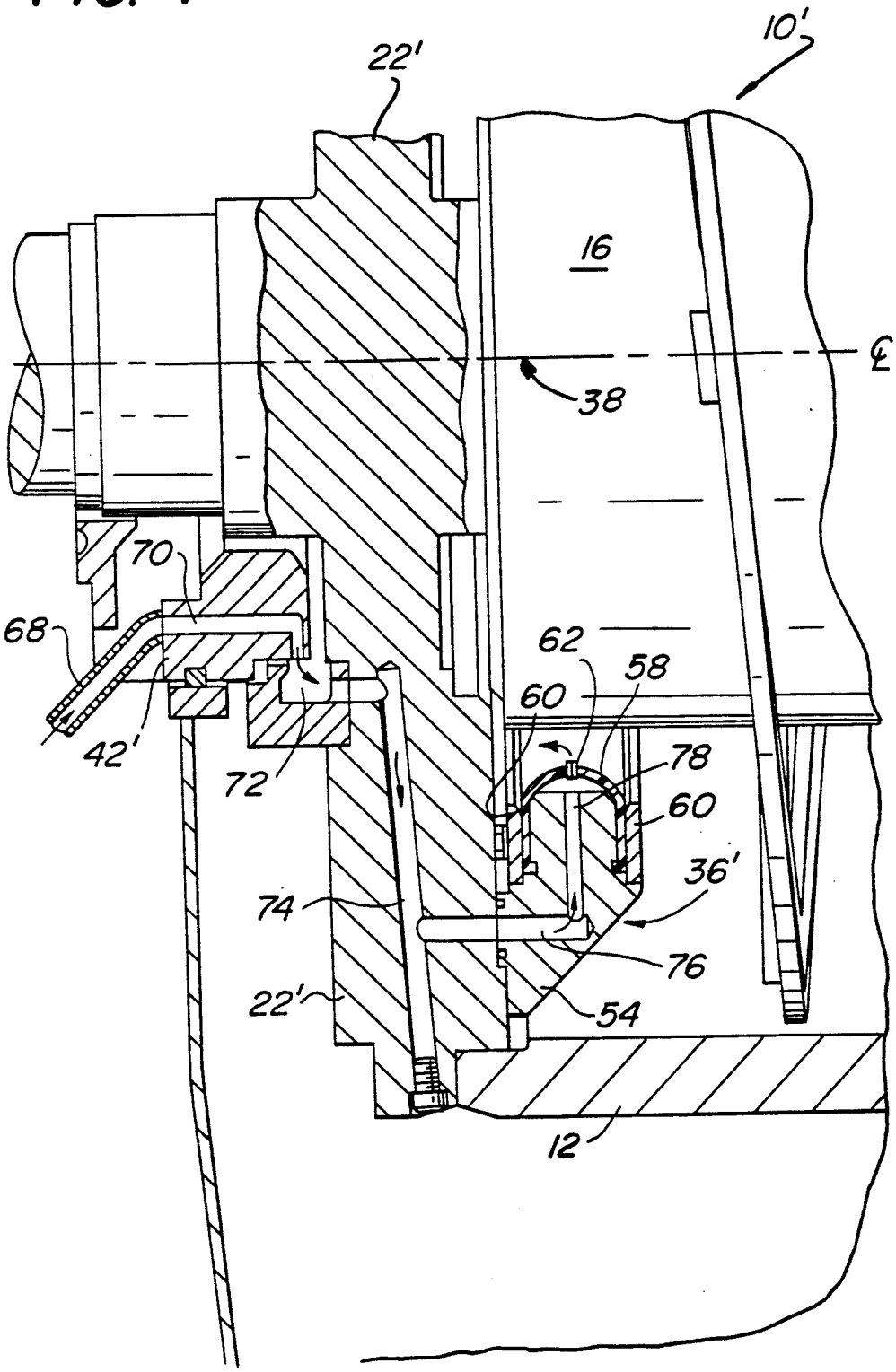
FIG. 4 is a further cross-sectional view of the embodiment of the present invention illustrated in FIG. 3.

In FIGS. 3 and 4, an alternate embodiment of the centrifuge 10' is illustrated. In this alternate embodiment, the front bowl hub 22' has been modified along with the structure of the pillow block 42'. In this embodiment, the pillow block 42' is attached directly adjacent to the front bowl hub 22'. This alternate mounting eliminates a substantial amount of structure which is supported inside of the pillow block 42' as compared to that shown in FIGS. 1 and 2.

In the upper part of FIG. 3, there is illustrated an inflatable dam structure 36' which is attached to the o inside wall of the front bowl hub 22' A notch is formed in the bowl hub 22' so that the position of the inflatable dam 36 is locked thereto. Mounting may be performed by a series of bolts or the like. The bladder 58 of inflatable dam 36' on the top of FIG. 3 is shown deflated. This bladder 58 is secured by clamping disks 60 which are attached to mounting block 54' by means of bolt 64. Inflatable dam 36' is positioned adjacent to the series of openings 24' in the front bowl hub 22'. A weir plate 26' is attached to the outside of the front bowl hub 22' adjacent each opening 24' by means of bolts 66.

As shown in the lower portion of FIG. 3 and as detailed in FIG. 4, the inflation of bladder 58 raises the pond level 40 radially inward of the weir surface formed by weir plates 26', and preferably to a position radially inward of the weir surface for the solids discharge 20 (see FIG. 1), i.e., to an above spillover condition.

It can be seen that the relative radial distance between the inflated bladder 58 on dam 36' and the weir surface defined by weir plates 26' is relatively small. However, this factor may be significant in the operation of the centrifuge. The tangential velocity of the discharging liquid from a decanter centrifuge determines much of the horse power requirements for rotation of the centrifuge bowl. The tangential liquid velocity is a function of the radius of the liquid weir surface. The position of plate 26' radially similar to the pond surface 40 defined by inflatable dam 36' results in a substantial reduction in the amount of horse power required for centrifuge operation, as compared to having no weir plate which would result in the liquid being accelerated to a tangential velocity at the largest radial dimension of the liquid discharge openings through the hub 22'.

The continuous structure of bladder 58 forms an annular weir that provides advantages over discontinuous weir structures. The pond level within the bowl is generally a function of the flow rate over the weir surface. The increase in circumferential weir length created by the inflatable dam 36 and 36' reduces restriction to the discharging flow as compared to the discontinuous weir plates. Thus, the height of the liquid above the weir surface formed by the bladder 58 is relatively lower than that which would be created by the same flow rate over a series of weir plates or the like. This annular structure further adds to the ability of the decanter centrifuge 10 and 10' to control the pond level. The turbulence near the front hub 22' is also reduced, resulting in less reentrainment of separated solids into the liquid being discharged.

As particularly illustrated in FIG. 4, the feed channels for the control liquid have been modified in the alternate embodiment of the centrifuge 10'. The control liquid is directed through an inlet pipe 68 which is attached to the pillow block 42'. Inlet pipe 68 communicates with internal channel 70 which feeds into trough 72 in the rotating portion of the centrifuge. The control liquid is then directed from trough 72 into the bowl hub 22' through radial passageway 74. Radial passageway 74 communicates with axial passageway 76 which directs the control liquid into the mounting block 54' and into the bladder 58 via feed passageway 78.

A leak bushing 62 has been illustrated in FIG. 4 but not in FIG. 3. It is contemplated that a leak bushing 62 will be placed at one or more positions along the circumference of the inflatable dam 36' (or 36). Again, the control liquid is directed from the leak bushings 62 into the discharging flow of liquid from the pond surface 40. The number of leak bushings included of the bladder is contemplated to be a matter of design preference and a function of the size and preferred operational characteristics of the centrifuge.

Figure 5:
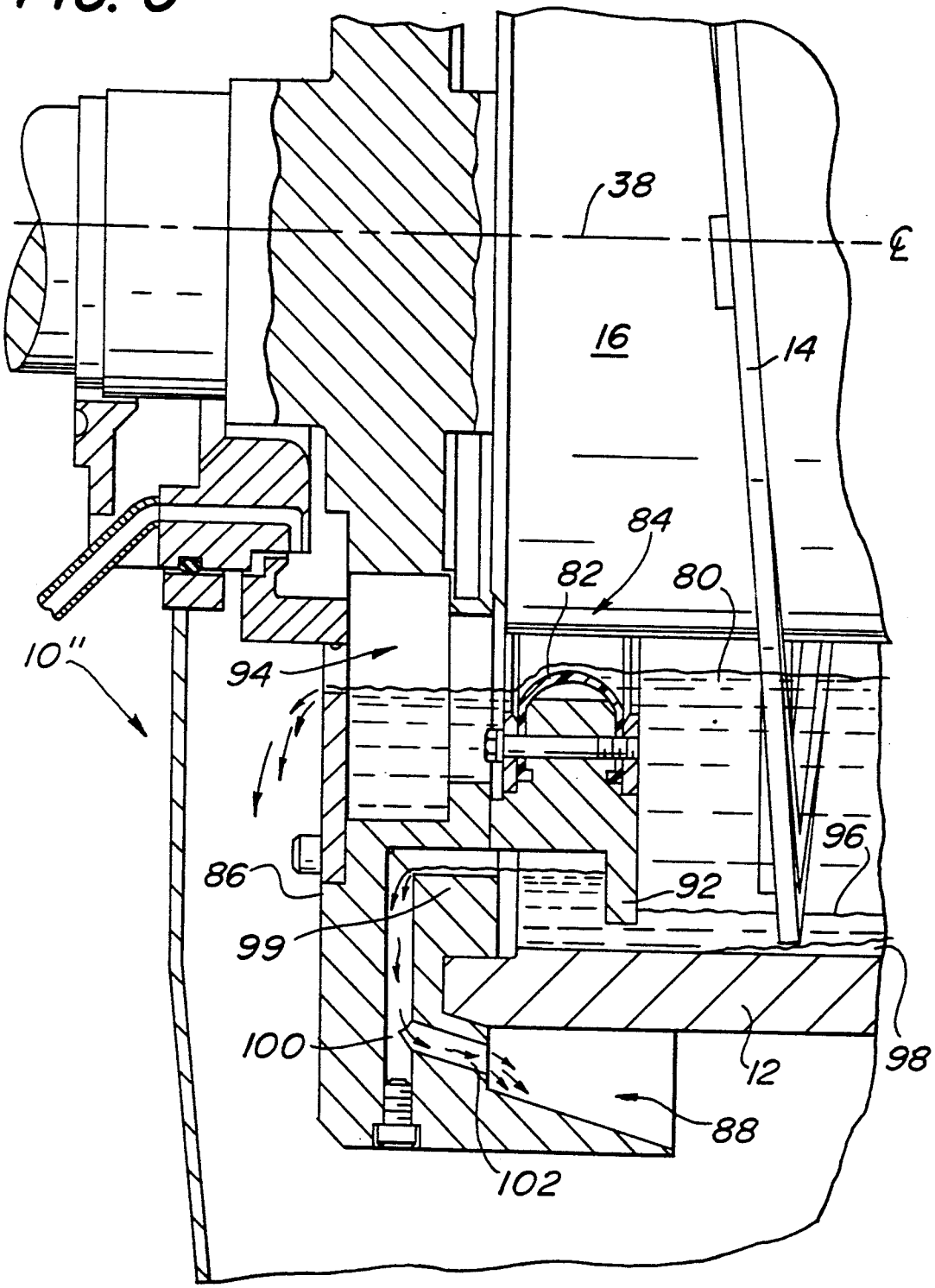
FIG. 5 is a cross-sectional view of a third alternate embodiment of a decanter centrifuge of the present invention.

In FIG. 5 there is illustrated a third embodiment of decanter centrifuge 10'' operating in accordance with the present invention. In this alternate embodiment, the centrifuge 10'' is contemplated to discharge three separate phases of materials, two liquid phases and one solids phase. The portion of the centrifuge 10'' illustrated in FIG. 5 shows the discharge of the two liquid phases. (Herein, the terms "liquid" and "solids" have been employed to describe the materials which are separable from the feed liquid as a result of the application of centrifugal force and then discharged from the centrifuge. The liquid will typically be lighter or less dense than the solids and will include a certain portion of the feed solids that have not been separated. In the description of two liquids, there is a difference in density between the two liquids within the feed material. The application of centrifugal force causes a separation between these two liquid phases. This separation is defined as resulting in a light liquid discharge and a heavy liquid discharge. The heavier material is typically referred to as a solids. This solids material will usually be a mixture of solids and liquid and is often referred to as a "heavy phase". The liquid feed mixture generally includes a specific concentration of suspended solids or other insoluble material therein. These solids are concentrated by the application of centrifugal force and form a phase or mixture of varying concentration within the bowl. This mixture includes coarse solids, fine solids and liquid. The liquid is often entrained within the solids. Because of the varying density of the solids as well as the varying degrees of centrifugal force acting on those solids within the bowl, the concentration of the separated heavy phase/solids layer may vary within the bowl. The concentration of the solids material that does not separate from the liquid and that is discharged with the liquid phase may also vary.)

The centrifuge 10'' includes an inflatable dam 84 positioned at the discharge outlet for the light liquid phase. The light liquid flows from the pond surface 80 over a bladder 82 secured to the inflatable dam structure 84 attached to the bowl hub 86. Inflatable dam 84 is similar to that illustrated in FIGS. 1–4. However, the bowl hub 86 is different in that a second opening is provided for discharge of the heavier liquid phase. Inflatable dam 84 includes a disk 90 which projects radially outward from the mounting block 92. Disk 90 serves to prevent the light liquid from discharging through passageway 88 intended for the heavy liquid.

An interface 96 is formed between the two liquid phases within the bowl 12. Illustrated in FIG. 5 is a portion of a solids layer 98 formed along the inside of the bowl wall 12. The interface between the solids 98 and the heavy liquid has been illustrated as a generally solid line. However, this interface is contemplated to be somewhat less defined than the interface 96 between the two liquid phases. Discharge of the solids 98 is made over the solids discharge weir, such as opening 20 in the bowl 12 shown in FIG. 1. The heavy liquid moves under disk 90 and over the weir surface 99 formed within the bowl hub 86. Internal passageways 100 and 102 form the communication between the weir surface 99 and the heavy liquid discharge port 88.

Inflation of the bladder 82 causes the pond surface 80 to move radially inward. This radially inward movement will result in a radially outward movement of the interface 96 between the light liquid and the heavy liquid. However, upon reaching equilibrium, the two liquid phases will maintain that relative position. The overall increase in liquid level within the bowl will result in an increase in pressure on the solids 98. If operating under the Lee patent principles, the discharge rate of the solids 98 will increase as a result of the inflation of dam 84, even if there are two liquids. However, the heavy liquid discharge rate will not increase based upon this inward radial movement of the inflatable dam 84.

Although the inflatable dam is shown as controlling the pond level of the light liquid in FIG. 5, this structure may also be used to control the weir diameter for the heavy liquid. Further, two inflatable dams could be used on a three-phase decanter, using an inflatable dam to control each liquid discharge. In this modification, two independent sets of control liquid passageways would be required.

In FIGS. 6–16, there are illustrated a series of alternate embodiments of the inflatable dam of the present invention. These embodiments are generally illustrated in a more graphic format rather than the detail shown in FIGS. 1–5.

Figure 6:
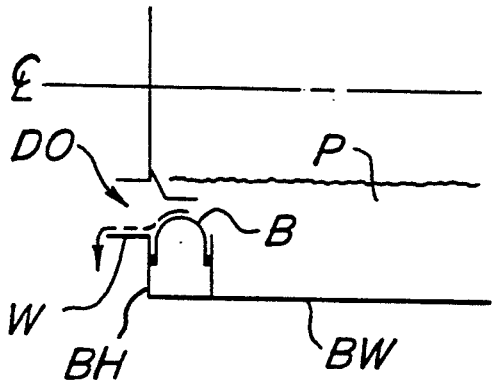
FIGS. 6–16 graphically illustrate further embodiments of a centrifuge in accordance with the present invention.

FIG. 6 illustrates an inflatable dam forming a restricting passageway. Bladder B is positioned adjacent to the bowl wall BW and the bowl hub BH. A discharge opening DO is provided adjacent to the bladder B. The relative movement of the bladder B, caused by the inflation and deflation thereof, results in a restriction of the discharge opening DO. Thus, the pond level may be positioned radially inward much farther than that resulting from the radial position of the inflatable dam itself. A weir W is provided on the bowl hub BH at a position radially outwardly of the bladder B so as to reduce the overall horse power requirements of the centrifuge.

Figure 7:
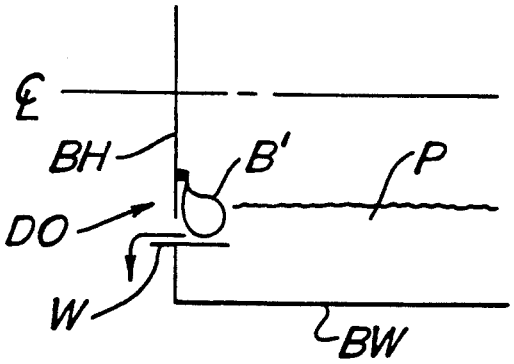

The embodiment shown in FIG. 7 is an alternate to that contemplated by FIG. 6. The bladder B′ is sealed, forming a structure similar to an inner tube of at ire and is attached to the bowl hub BH. Inflation of the bladder B causes a restriction of the discharge opening DO adjacent to the weir surface W. Thus, the bladder B serves to position the pond surface at the desired radial position.

Figure 8:
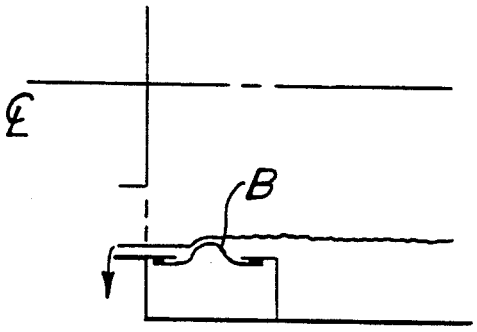

FIG. 8 shows an alternate mounting and structure for an inflatable bladder B. In this embodiment, the bladder B does not form a U-shaped structure as illustrated previously, but rather has extensions in the axial direction with respect to the center line of the bowl.

Figure 9:
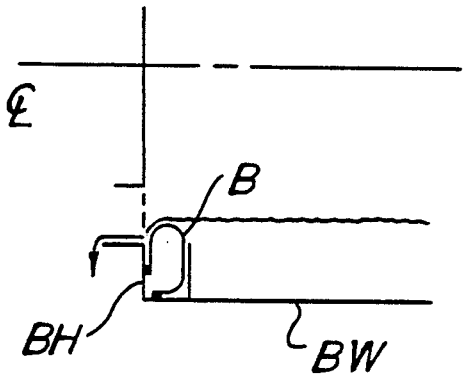

FIG. 9 shows a still further mounting structure for a bladder B of the inflatable dam of the present invention. The bladder B is attached at opposite ends to different locations on the bowl hub BH and the bowl wall BW.

Figure 10:
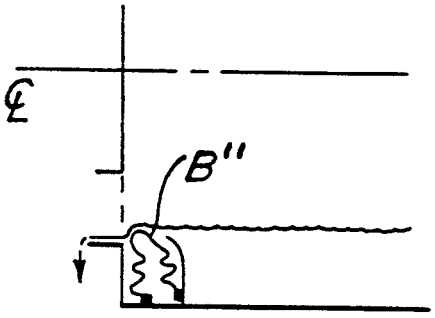

FIG. 10 illustrates an alternate embodiment of a bladder B″ for an inflatable dam. The bladder B″ is shown in cross section to include a collapsible accordion type structure. It is contemplated that the undulations in the side walls of the bladder B″ will permit further radial motion of the inflatable dam than would be possible with a structure not having undulations (which requires substantial stretching of the bladder material).

Figure 11:
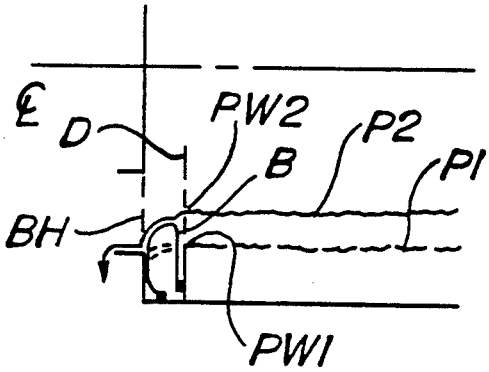

FIG. 11 shows an alternate embodiment of a mounting structure for a bladder B which provides for the inflatable dam to close a first passageway PW1 in a dam D located within the bowl adjacent the bowl hub BH. The restriction to passageway PW1 by bladder B causes a stepped increase in pond level up to the level of the next passageway PW2 in dam D. This configuration is useful during start up when the pond level P1 is desired to be set at a below spillover. The step increase in the passageway from PW1 to PW2 causes a step increase to an above spillover condition or pond level P2.

Figure 12:
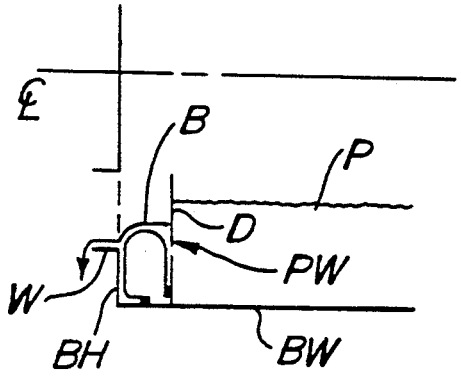

FIG. 12 shows an alternate embodiment for the mounting of bladder B. A dam D is provided within the bowl on the opposite side of the bladder B from the weir surface W on bowl hub BH. A passageway PW is provided in the dam D. The bladder B forms a restriction for the flow from the pond P to the weir W through passageway PW. The amount of restriction changes the pond level. An increase in the flow rate causes the pond to rise above the radial level of the passageway and inflatable dam formed by bladder B.

Figure 13:
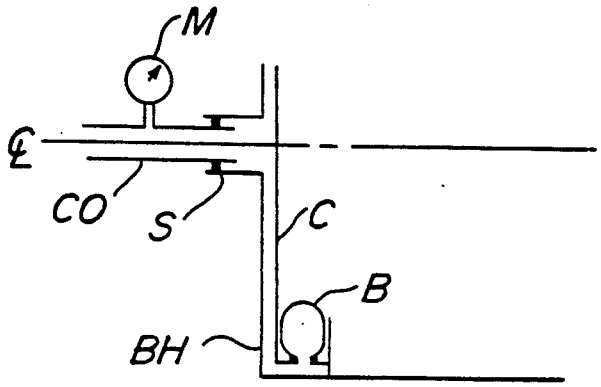

FIG. 13 shows an alternate means for inflating the bladder B. In this embodiment, an inlet conduit CO is connected via seals S into a channel C within the bowl hub BH. A meter M controls the pressure of the control fluid through an inlet conduit CO which feeds the radially extending channel C. In this embodiment, a gas could be used as the control fluid to control inflation of bladder B. If a gas were to be used as the control fluid, leak bushings would be unnecessary.

Figure 14:
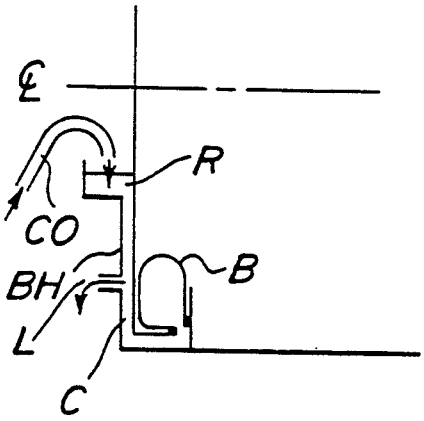

FIG. 14 shows a further alternate embodiment of the control liquid feed mechanism. The control liquid is input through conduit CO into reservoir R which is mounted on the bowl hub BH. The amount of control liquid within the reservoir R determines the pressure within and the inflation of bladder B and thus controls the pond level. The control liquid exits through leak bushing L positioned on the bowl hub BH. Having the leak bushing(s) L on the bowl hub BH, rather than on the bladder B, prevents particles within the control liquid from accumulating in the bladder B. To vary the bladder B inflation, the rate of flow of the control liquid is varied, until equilibrium is reached at the desired pond level. In order to maintain a constant pond level, the input of control liquid through conduit CO must be equal to the amount of liquid discharged through the leak bushing L.

Figure 15:
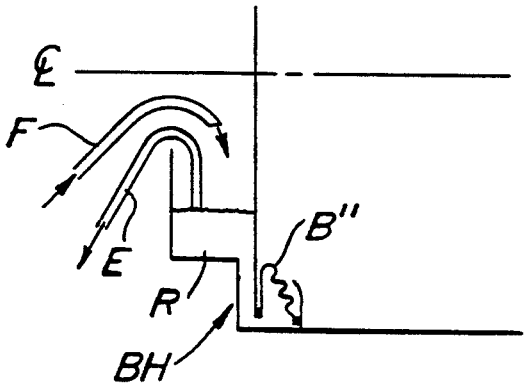

FIG. 15 shows an alternate embodiment of the structure shown in FIG. 14. In this embodiment, an accordion type bladder B″ is illustrated. A feed tube F directs control liquid into reservoir R mounted on bowl hub BH. An exhaust tube E having a skimmer thereon removes control liquid for the reservoir R. The skimmer E may be moved radially by mechanical means (not shown) to a select level within reservoir R which gives the desired inflation of the bladder B″. In this configuration, leak bushings are not required. Deflation of the bladder B is accomplished by moving the skimmer E radially outward to remove the control liquid from the reservoir R. To increase inflation, control liquid is added to reservoir R and the skimmer is moved radially inward. In the present embodiment, the flow of control liquid from feed tube F need only be sufficient to fill the reservoir R to the radial level of the skimmer on tube E. The embodiments shown in FIGS. 13 and 15 utilize static pressure to maintain inflation of the bladder. The other embodiments utilize a flow of control liquid through the leak bushings to control the inflation level.

Figure 16:
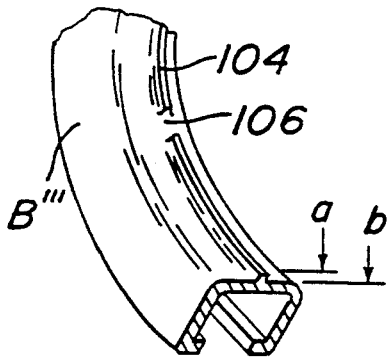

FIG. 16 illustrates a portion of an alternate embodiment of a bladder B‴ as contemplated for use with the present invention. Included on the upper surface of the bladder B‴ is a ridge 104 having a series of notches 106 therein. The bladder B‴ is contemplated to serve as a weir surface similar to the notched fixed weir described in LaMontagne U.S. Pat. No. 4,575,370, which is identified above and herein incorporated by reference. In this embodiment, centrifuge start up can be controlled by flow rate of the feed as well as by the inflation of the bladder B'''. Start up can take place with radius "a" of the inflatable dam being radially inward of the solids discharge radius and the liquid flowing through notches 106 at radius "b". This start up condition is contemplated to provide a below spillover pond level. At normal flow rates, the liquid discharge would flow over the ridge 104 on the surface of bladder B''' and create a pond level at or above radius "a". In this embodiment, the ridge 104 increases the effective radial range of adjustment of the inflatable dam from start up at low flow to operation at normal flow rates.

Figure 17:
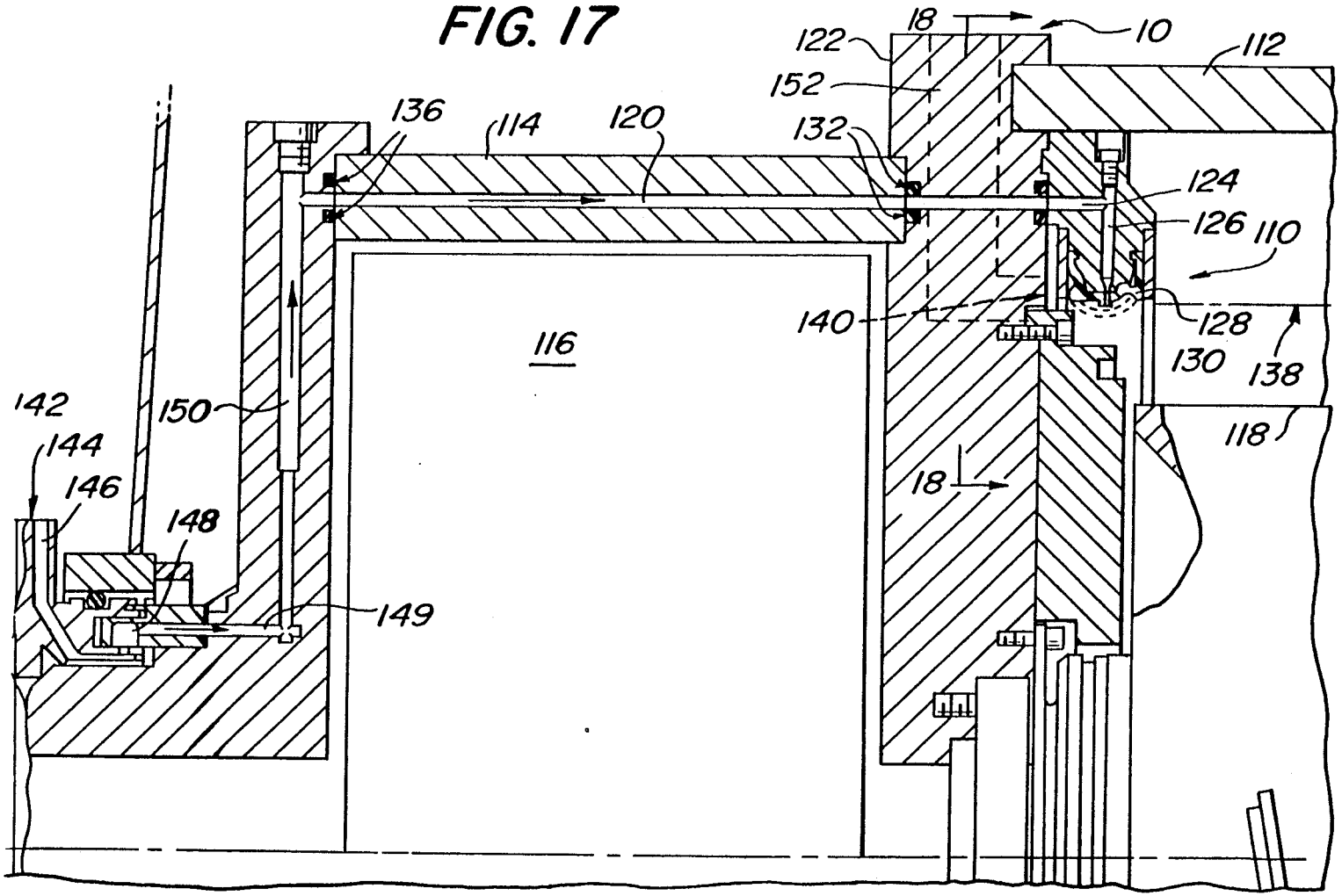
FIG. 17 is a cross-sectional view of a further alternate embodiment of a centrifuge in accordance with the present invention.
Figure 18:
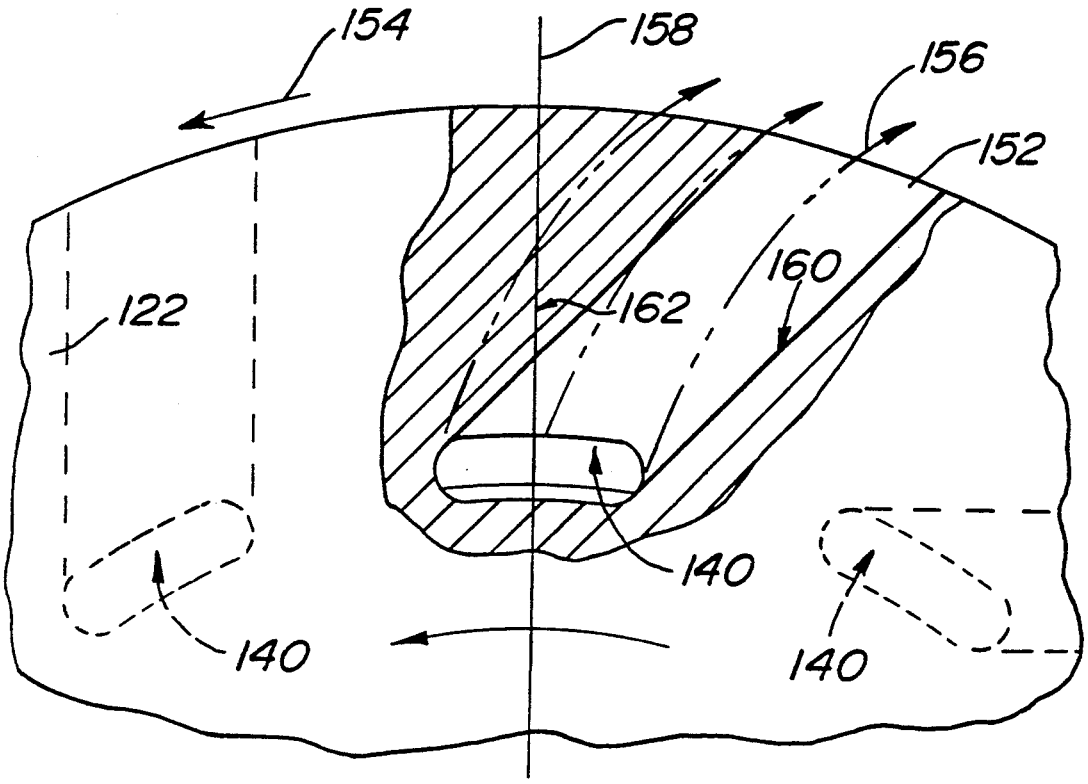
FIG. 18 is a cross-sectional view of the embodiment shown in FIG. 17 as taken along line 18—18.

Illustrated in FIGS. 17 and 18 is a further embodiment of the present invention. In this embodiment the centrifuge 10''' includes an inflatable dam 110 similar to that shown in FIGS. 1–4. However, the centrifuge 10''' includes a bowl 112 and its corresponding bowl hub 122 which are attached directly to the gear box housing 114. The gear box housing 114 includes the gear arrangement or other structure 116 which defines the differential speed of rotation between the bowl 112 and the conveyor 118. The mounting of the gear box housing 114 and its corresponding gear box 116 adjacent to the bowl hub 122 permits the gear box structure and the centrifuge bowl to be positioned between the bearings at the opposite ends of the centrifuge. Thus, the amount of structure cantilevered outside of pillow block 142 is substantially reduced. In a vertical centrifuge, mounting of the gear box adjacent the bowl hub is also possible. However, only a single bearing is typically used in this type structure.

As illustrated in FIG. 17, the control liquid for the inflatable dam 110 is input through opening 144. The control liquid passes through passageway 146 and into trough 148. Thereafter, the control liquid is directed through passageway 149 and passageway 150 and into the gear box housing 114 through transverse passageway 120. Transverse passageway 120 communicates with a separate passage 124 within the bowl hub 122. Thereafter, the control liquid is directed into the inflatable dam 110 via radial passageway 126. The control liquid determines the height of inflation of the bladder 128 by means of the pressure resulting from the volume of control liquid directed through input 144.

The ability to mount the gear box housing 114 and its corresponding gear box 116 is created by the fact that there are no weir plates mounted on the outside periphery of the bowl hub 122. Thus, the gear box housing 114 can be mounted directly to the bowl hub 122. The transverse passageway 120 is sealed with respect to the bowl hub 122 by seals 132 and with respect to the side wall 134 of the gear box 116 by seals 136. The liquid from the pond surface 138 is directed over the inflatable dam 110 and into axial discharge opening 140. Axial discharge opening communicates with radial discharge opening 152 which extends through the bowl hub 122.

Previously, mounting of the gear box directly to the bowl hub required the pond to be set at a radial level outside of the gear box housing. The relationship of the bowl diameter to that of the gear box housing often limited the overall depth of the pond in the bowl. Alternatively, the weir plates would be required to be positioned inside of the bowl so as to direct the liquid through channels inside the bowl hub or the like. The mounting of weir plates inside the bowl limits adjustability of the pond since the bowl hub would be required to be removed in order to reset the pond level. The inflatable dam, which is adjustable while the centrifuge is operating and which is positioned inside of the bowl, permits the position of the pond within the bowl to be radially inward of the housing for the gear box.

The path of radial discharge opening 152 within the bowl hub 122 is more particularly illustrated in FIG. 18. A series of axial discharge openings 140 are provided around the center line or axis of rotation of the centrifuge 10'''. The path of the discharging liquid as it exits the pond surface 138 and flows over the inflatable dam 110 is axial through the openings 140. However, this discharging liquid also includes a rotational component as a result of the rotation of the bowl 112 and bowl hub 122. The direction of rotation of the bowl hub 122 is identified in FIG. 18 by the arrow numbered 154. As the liquid discharge exits opening 140, the flow moves radially outward from the center line of the centrifuge 10'''. However, the tangential speed of the liquid is that speed of the bowl at the radius of the openings 140. As the liquid continues to progress radially outward through passageway 152, the tangential speed of the bowl hub 122 increases as the radius increases. Thus, the speed of the liquid lags behind the rotation of the bowl. The relative radial path of the liquid with respect to the bowl is generally designated by the arrows numbered 156 in FIG. 18.

As shown in FIG. 18, radial discharge opening 152 is skewed with respect to a radius 158 extending from the center line of the centrifuge 10'''. The axial discharge opening 140 lies along radius 158 and defines the initial position of the discharge for the liquid. The flow of liquid discharge is contemplated to be directed in such a manner so as not to impinge upon the side wall 160 of passageway 152, but may impinge upon the opposite side wall 162. If the liquid were to impinge upon side wall 160, the liquid would retard the rotation of the bowl, which could increase the power requirements for rotation. Although the liquid pathway 156 may not necessarily increase the rotation of the bowl hub 122 as liquid is directed along side wall 162, the additional power requirements that may result from a substantially radial passageway are eliminated by the structure of passageway 152.

In FIGS. 19 and 20 there is illustrated a still further embodiment of a centrifuge 10'''' having an inflatable dam as contemplated by the present invention. In each of the embodiments discussed above, the inflation of the bladder will increase the height of the fluid directed against the side wall of the bladder. Thus, the inflation of the bladder results in an increased force on the bladder in the axial direction due to the increased height of the pond. If the range of radial variation of the pond as created by the inflatable dam is contemplated to be large, it may be necessary to include multiple levels of inflation so as to restrict the axial force against the bladder.

In FIG. 19, the centrifuge 10'''' includes a first inflatable dam 170 mounted radially outward of a second dam 172 which also includes an inflatable construction. Both dam structures 170, 172 are positioned on mounting block 174 attached to the bowl hub 176. The bowl hub 176 includes a series of passageways 178 for discharge of the liquid from the centrifuge 10''''. At start up or under certain operational conditions, the flow of liquid from the pond 180 is directed through openings 182 in the mounting block 174, past dam 170 and through the discharge passageways 178. In this type operation, the radial position of the pond 180 is determined as a function of the level of weir plates 184 adjacent discharge passageways 178 and the restriction to flow formed by the inflation of dam 170 adjacent passageways 182.

As illustrated in FIG. 20, the restriction to flow through passageway 182 created by inflatable dam 170 may be so great as to raise the level of the pond 180 to the radial position of the second inflatable dam 172. Upon the pond 180 reaching this second level, the control is accomplished primarily as a function of the inflation of dam 172. It should be noted, however, that the structure shown in FIGS. 19 and 20 may successfully operate with flow being directed through passageway 182 and over the second dam 172. In this regard, dam 170 serves as an inflatable valve while limiting the overall inflation required to control the radial position of the pond from the level of weir plates 184 to the level of dam 172.

It should also be noted that, although the embodiments of the inflatable dam as shown herein are mounted within the bowl, it is contemplated that the inflatable dam could be placed adjacent to the bowl hub outside of the bowl. This alternate structure renders the separate weir plates unnecessary.

The present invention may be embodied in other specific forms without departing from the spirit or essential attributes thereof and, accordingly, reference should be made to the appended claims, rather than to the foregoing specification, as indicating the scope of the invention.

I claim:

1. A decanter centrifuge comprising: (a) a bowl rotatable about its longitudinal axis, the bowl comprising a solids discharge having a weir surface thereon; (b) a screw conveyor coaxially mounted for rotation within the bowl, the conveyor having a series of conveyor flights extending from a central hub to a position adjacent the inside wall of the bowl; (c) feed means for introducing a feed mixture into the rotating bowl, the rotation of the bowl subjecting the feed mixture to a centrifugal force, separating the feed mixture into separate layers of solids and liquids dependent upon density; (d) means for rotating the bowl and the conveyor at a differential speed with respect to one another, such that the conveyor flights continuously move the separated solids layer toward and discharge the solids layer from the solids discharge; (e) a bowl hub attached to the bowl, the bowl hub having a series of openings therein forming liquid discharge for the separated liquid layer; and (f) inflatable means positioned adjacent the bowl hub, the inflation of the inflatable means altering the rate of the solids layer discharge by varying the radial position of the discharge of the liquid layer from the bowl.

2. A decanter centrifuge as claimed in claim 1 further comprising an annular baffle mounted on the screw conveyor and extending radially outwardly therefrom to a position proximal to the inside wall of the bowl, the baffle forming a restrictive passageway for the solids layer such that only the solids layer material is permitted to pass past the baffle toward the solids discharge as a result of the differential speed of the conveyor with respect to the bowl.

3. An apparatus as claimed in claim 2 wherein the inflatable means is adapted to vary the radial position of the liquid discharge to a position radially inward of the position of the weir surface of the solids discharge ports.

4. A decanter centrifuge as claimed in claim 1 wherein the inflatable means includes a mounting block attached to the bowl hub, a bladder secured to the mounting block, and means for directing a control liquid into the mounting block for controlling the inflation of the bladder.

5. A decanter centrifuge as claimed in claim 4 further comprising at least one leak bushing within the bladder, the leak bushing permitting flow of control liquid from the bladder, the control means varying the radial position of the discharge of the liquid layer from the bowl as a function of the pressure of the control liquid in the bladder.

6. A decanter centrifuge as claimed in claim 1 further comprising a series of weir plates attached to the bowl hub adjacent the liquid discharge ports and forming a discharge weir surface for the liquid layer from the bowl, the radial position of the weir surface formed by the weir plates being radially outward of the weir surface of the solids discharge ports, and the inflatable means varying the effective discharge level of the liquid layer within the bowl to range radially inward and outward of the weir surface of the solids discharge ports.

7. A decanter centrifuge as claimed in claim 1 wherein the inflatable means includes a bladder having one or more of leak bushings therein.

8. A decanter centrifuge as claimed in claim 1 wherein the inflatable means is attached to the bowl hub inside the bowl.

9. A decanter centrifuge as claimed in claim 1 wherein the inflatable means includes an annular inflatable bladder having a U-shaped cross-section.

10. A decanter centrifuge as claimed in claim 1 wherein the inflatable means forms a restriction to the flow of liquid layer from the bowl through the liquid discharge openings in the bowl hub.

11. A decanter centrifuge as claimed in claim 10 further comprising an annular baffle projecting radially inwardly from the bowl and having an opening therein, the inflatable means forming a restriction to the flow from the bowl to the liquid discharge openings.

12. A decanter centrifuge as claimed in claim 11 wherein the inflatable means is positioned between the annular baffle and the bowl hub.

13. A decanter centrifuge as claimed in claim 11 wherein the annular baffle includes a second opening radially inward of the first-mentioned opening, such that the inflation of the inflatable means to restrict the flow through the first-mentioned opening creates a liquid level within the bowl to the radial position of the second mentioned opening.

14. A decanter centrifuge as claimed in claim 13 wherein the second opening in the annular baffle is at a radial position inward of the radial position of the weir surface for the solids discharge ports.

15. A decanter centrifuge as claimed in claim 1 wherein the inflatable means includes an annular inflatable bladder.

16. A decanter centrifuge as claimed in claim 1 further comprising a second set of discharge openings in the bowl hub for purposes of discharging a separate portion of the liquid layer.

17. A decanter centrifuge as claimed in claim 1 wherein the inflatable means includes a flow meter which regulates the flow of a control fluid into an inflatable bladder.

18. A decanter centrifuge as claimed in claim 17 wherein the control fluid is a liquid.

19. A decanter centrifuge as claimed in claim 17 wherein the control fluid is a gas.

20. A decanter centrifuge as claimed in claim 1 wherein the inflatable means further comprises an annular inflatable bladder and reservoir means attached to the bowl hub, the reservoir means adapted to receive a control liquid for feeding to the inflatable bladder, the level of control liquid within the reservoir means controlling the amount of inflation of the bladder.

21. A decanter centrifuge as claimed in claim 20 wherein the inflatable means further comprising a feed tube for feeding control liquid into the reservoir means and a skimmer tube for removing control liquid from the reservoir means, the level of control liquid in the reservoir means controlling the pressure within and the inflation of the bladder.

22. A decanter centrifuge as claimed in claim 1 wherein the inflatable means includes an inflatable bladder having an accordion configuration.

23. A decanter centrifuge as claimed in claim 1 wherein the inflatable means includes an inflatable bladder having a U-shaped configuration.

24. A decanter centrifuge as claimed in claim 1 wherein the inflatable means includes an annular bladder having a U-shaped configuration wherein the bight of the U-shape projects radially inwardly within the bowl and forms a weir surface for the flow of the liquid layer from the bowl through the liquid discharge ports.

25. A decanter centrifuge as claimed in claim 24 wherein the bight of the U-shape includes a discontinuous ridge having a series of notches therein, the radial position of the ridge being inward of the radial position of the notch.

26. A decanter centrifuge as claimed in claim 1 further comprising means for supporting the bowl for rotation, the rotating means including a gear box for creating the differential rotation of the bowl with respect to the conveyor, the gear box mounted between the supporting means and the bowl.

27. A decanter centrifuge as claimed in claim 26 wherein the inflatable means is attached to the bowl hub inside the bowl.

28. A decanter centrifuge as claimed in claim 27 wherein the liquid discharge ports in the bowl hub include a first passageway extending axially with respect to the bowl and a second passageway for directing the liquid discharge within the bowl hub radially with respect to the axis of the bowl.

29. A decanter centrifuge as claimed in claim 28 wherein the second passageway is angled with respect to a radius extending from the axis of rotation of the bowl, such that the first passageway leads the second passageway in the direction of rotation of the bowl.

30. A decanter centrifuge as claimed in claim 1 wherein the liquid discharge ports in the bowl hub include a first passageway extending axially with respect to the bowl and a second passageway for directing the liquid discharge within the bowl hub radially outward with respect to the axis of the bowl.

31. A decanter centrifuge as claimed in claim 30 wherein the second passageway is angled with respect to a radius extending from the axis of rotation of the bowl, such that the first passageway leads the second passageway in the direction of rotation of the bowl.

32. A decanter centrifuge as claimed in claim 30 wherein the inflatable means is attached to the bowl hub inside the bowl.

33. A decanter centrifuge as claimed in claim 1 wherein the inflatable means further comprises a first and second inflatable bladder, the first bladder positioned adjacent the bowl hub radially outward of the solids discharge weir, the first bladder adapted to inflate to close a passageway which directs liquid from the bowl to the liquid discharge ports in the bowl hub, and the second bladder positioned to inflate to a level radially inward of the solids discharge weir upon closing of the passageway by the first bladder.

34. A decanter centrifuge comprising:

a solid bowl rotatable about its longitudinal axis, the bowl including a cylindrical portion and a frusto conical portion, the bowl further comprising a series of solids discharge ports therein at a restricted diameter within the frusto conical portion, the discharge ports defining a weir surface at a fixed radial position thereon;

a screw conveyor coaxially mounted for rotation within the bowl, the conveyor having a series of conveyor flights extending from a central hub to a position adjacent the inside wall of the bowl;

feed means for introducing a liquid feed mixture into the rotating bowl, the rotation of the bowl subjecting the feed mixture to a centrifugal force, separating the feed mixture into separate heavy and light layers dependent upon density of the materials within the mixture;

means for rotating the bowl and the conveyor at a differential speed with respect to one another, such that the conveyor flights move the separated heavy layer towards the solids discharge ports in the frusto conical portion of the bowl and discharge the heavy layer from the bowl over the weir surface of the solids discharge ports;

a bowl hub attached to the opposite end of the cylindrical portion of the bowl from the frusto conical portion, the bowl hub having a series of openings therein forming liquid discharge ports for the separated light layer; and inflatable means positioned adjacent the bowl hub within the bowl, the inflatable means including an annular inflatable bladder having a U-shaped cross-section, and means for directing a control liquid into the bladder so as to inflate the bladder and vary the radial position of the bight of the U-shaped cross-section with respect to the radial position of the weir surface of the solids discharge ports.

35. A decanter centrifuge as claimed in claim 34 wherein the inflatable means further comprises a leak bushing within the inflatable bladder for discharging the control liquid therethrough, the pressure of the control liquid within the inflatable dam varying the radial position of the bight of the bladder.

36. A decanter centrifuge as claimed in claim 34 wherein the inflatable means further comprises a reservoir mounted on the bowl hub and a leak bushing on the bowl hub, the flow of control liquid into the reservoir determining the inflation of the bladder.

37. A decanter centrifuge comprising a bowl rotatable about its longitudinal axis, the bowl having a solids discharge opening therein and having a weir surface thereon, a screw conveyor coaxially mounted for rotation within the bowl, the conveyor having a series of conveyor flights extending from a central hub to a position adjacent the inside wall of the bowl, feed means for introducing a feed mixture into the bowl during rotation thereof, the rotation of the bowl subjecting the feed mixture to a centrifugal force, separating the feed mixture into separate layers of solids and liquids dependent upon density, means for rotating the bowl and the conveyor at a differential speed with respect to one another, such that the conveyor flights continuously move the separated solids layer toward and discharge the solids layer from the solids discharge, a bowl hub attached to the bowl, the bowl hub having a series of openings therein forming liquid discharge ports for the separated liquid layer, an annular baffle mounted on the screw conveyor and extending radially outwardly therefrom to a position forming a restricted passageway for the solids layer such that only the solids layer is permitted to pass past the baffle toward the solids discharge as a result of the differential speed of the conveyor with respect to the bowl, and inflatable means positioned within the bowl adjacent the bowl hub, the inflation of the inflatable means altering the rate of solids discharge and the characteristics of the solids moving past the baffle toward the solids discharge.

38. An apparatus as claimed in claim 37 wherein the inflatable means is adapted to vary the radial position of the liquid discharge to a position radially inward of the position of the weir surface of the solids discharge.

39. A decanter centrifuge as claimed in claim 37 further comprising at least one leak bushing for the inflatable means, means for directing a control liquid into the inflatable means for controlling inflation thereof, the control means in conjunction with the leak bushing varying the pressure of the control liquid within the inflatable means.

40. A decanter centrifuge as claimed in claim 39 wherein the discharge of control liquid from the leak bushing is directed into the separated liquid layer within the bowl.

41. A decanter centrifuge as claimed in claim 39 wherein the inflatable means includes an annular bladder, the control means varying the radial position of the bladder during inflation.

42. A decanter centrifuge as claimed in claim 41 wherein the bladder is secured to a mounting block, the mounting block attached to the bowl hub.

* * * * *